US007683529B2

(12) United States Patent
Hong et al.

(10) Patent No.: US 7,683,529 B2
(45) Date of Patent: Mar. 23, 2010

(54) PANEL OF SLIM CATHODE RAY TUBE WITH ELECTRON BEAM DEFLECTION ANGLE OF 110 DEGREES OF MORE

(75) Inventors: Byong Gyu Hong, Kyungsangbuk-do (KR); Sam Ki Choi, Daegu-si (KR); Young Woong Kim, Kumi-si (KR)

(73) Assignee: Meridian Solar & Display Co., Ltd., Seoul (KR)

( * ) Notice: Subject to any disclaimer, the term of this patent is extended or adjusted under 35 U.S.C. 154(b) by 1085 days.

(21) Appl. No.: 11/346,154

(22) Filed: Feb. 3, 2006

(65) Prior Publication Data

US 2006/0186783 A1 Aug. 24, 2006

(30) Foreign Application Priority Data

Feb. 14, 2005 (KR) ..... 10-2005-0011951
Feb. 14, 2005 (KR) ..... 10-2005-0011952
Feb. 14, 2005 (KR) ..... 10-2005-0011954

(51) Int. Cl.
*H01J 29/92* (2006.01)

(52) U.S. Cl. ..... 313/477 R; 313/364

(58) Field of Classification Search ..... 313/477 R
See application file for complete search history.

(56) References Cited

U.S. PATENT DOCUMENTS 6,259,206 B1 * 7/2001 Tsuchiya et al. ..... 315/3
6,504,298 B2 * 1/2003 Van Den Brink et al. . 313/477 R
6,597,099 B1 * 7/2003 Kyono ..... 313/477 R
6,812,633 B2 * 11/2004 Kim et al. ..... 313/477 R
2004/0027046 A1 * 2/2004 Choo ..... 313/477 R
2005/0052114 A1 * 3/2005 Kim ..... 313/477 R

FOREIGN PATENT DOCUMENTS

KR 10-2006-0025790 A 3/2006

OTHER PUBLICATIONS

WO 2004/032173 A1, Sterken et al., Cathode ray tube with reduced depth, Apr. 15, 2004.*

* cited by examiner

*Primary Examiner*—Toan Ton
*Assistant Examiner*—Britt D Hanley
(74) *Attorney, Agent, or Firm*—Birch, Stewart, Kolasch & Birch, LLP

(57) ABSTRACT

Disclosed herein is a panel of a slim cathode ray tube constructed such that the deflection angle of an electron beam is 110 degrees or more. The slim cathode ray tube includes a tube part constituted by joining the panel and a funnel with each other. The panel includes a face part, a side wall disposed around the face part such that the side wall is bent toward the funnel, and a seal edge formed at the side wall, the panel being joined with the funnel at the seal edge. On the assumption that the thickness of the center of the face part is Tc, the thickness of the long side of the seal edge is Tx, the thickness of the short side of the seal edge is Ty, and the thickness of the diagonal part of the seal edge is Td, the panel is constructed such that the following inequalities are satisfied: $0.8 \leqq Tc/Ty \leqq Tc/Tx \leqq 1.0 \leqq Tc/Td$ and $Td < Tx < Ty$, and the side wall has an outer skirt angle of 0.5 to 1.5 degrees.

9 Claims, 5 Drawing Sheets

PANEL OF SLIM CATHODE RAY TUBE WITH ELECTRON BEAM DEFLECTION ANGLE OF 110 DEGREES OF MORE

BACKGROUND OF THE INVENTION

1. Field of the Invention

The present invention relates to a slim cathode ray tube, and, more particularly, to a panel for color cathode ray tubes wherein the thickness of the center of the panel, and the thicknesses of a seal edge are appropriately set, and the outer skirt angle of the panel is appropriately set, thereby minimizing the concentration of stress caused due to the increase of a deflection angle, providing sufficient rigidity, improving the explosion-resistance characteristic and moldability of the panel, and effectively preventing slippage of a reinforcing band.

2. Description of the Related Art

Generally, a cathode ray tube is an apparatus that converts an electric signal into an electron beam and scans the electron beam on a fluorescent screen to display picture on a panel.

FIG. 1 is a side view, partially cut away, illustrating a conventional cathode ray tube, and FIG. 2 is a sectional view illustrating a panel constituting the conventional cathode ray tube.

As shown in FIGS. 1 and 2, the conventional cathode ray tube comprises a panel 1 and a funnel 2, which are joined with each other to constitute a tube part 10.

Inside the panel 1 is disposed a shadow mask 3, which is supported by a frame 4 such that the shadow mask 3 is approximately parallel with the panel 1. The frame 4 is fixed to the panel 1 via a spring 5. Inside the funnel 2 is disposed an inner shield 6 for shielding an external geomagnetic field to prevent the path of an electron beam from being curved by the external geomagnetic field.

In the rear part of the funnel 2 is fitted an electron gun 7 for generating an electron beam. At the outside of a neck part of the funnel 2 is mounted a deflection yoke 8 for deflecting an electron beam approximately 110 degrees or less.

In the conventional cathode ray tube with the above-stated construction, an electron beam emitted from the electron gun 7 is deflected above and below and right and left by the deflection yoke 8, and is then transmitted to the panel 1. Specifically, the deflected electron beam passes through-holes of the shadow mask 3, and is then transmitted to a fluorescent screen 9 coated on the inner surface of the panel 1. At this time, the fluorescent screen 9 is illuminated by the energy of the electron beam. Consequently, a picture is reproduced such that users can see the picture reproduced through the panel 1.

Meanwhile, the panel 1 and the funnel 2 are joined to each other at a seal edge 1*x*, 1*y*, and 1*d* of the panel 1 by a frit sealing process, the electron gun 7 is fitted into the rear part of the funnel 2 by a subsequent encapsulation process, and a vacuum is formed in the tube part 10 by an extraction process. In this way, the cathode ray tube is manufactured.

When the tube part 10 is in the vacuum state, considerable tensile and compression stresses are applied to the panel 2 and the funnel 2.

Especially when the overall length of the tube part 10 is decreased, the inner volume of the tub part 10 is correspondingly decreased. As a result, stress applied to the tube part 10 is increased. Recently, the neck part of the funnel 2 has been formed in the shape of a rectangle to reduce current necessary for the deflection of an electron beam, and thus, to reduce the power consumption of the deflection yoke 8. In this case, however, stress applied to the tube part 10 is further increased.

Referring to FIG. 2, CFT indicates the thickness of the center of the panel 1, and SET indicates the thickness of the seal edge of the panel 1, at which the panel 1 and the funnel 2 are joined with each other. Specifically, SET(Tx) indicates the thickness of the seal edge of the panel 1 at the long side part, SET(Ty) indicates the thickness of the seal edge of the panel 1 at the short side part, and SET(Td) indicates the thickness of the seal edge of the panel 1 at the diagonal part.

When CFT of the panel 1 is decreased, stress of the tube pat 10 is concentrated on the panel 1. When SET (Tx, Ty, Td) of the panel 1 is decreased, on the other hand, stress is concentrated on the seal edge of the panel 1, and therefore, a possibility for the tube part 10 to be damaged is increased.

Consequently, the CFT and SET setting is very important to appropriately distribute the stress of the panel 1. Specifically, when CFT and SET are large, the stress is prevented from being concentrated on a specific portion of the panel 1, as shown in FIG. 3. However, the total volume of the panel 1 is increased, and therefore, manufacturing costs of the panel 1 are also increased.

In conclusion, setting CFT and SET of panel 1 is a process of finding the optimum point at the relationship between the stress and the costs.

In the conventional cathode ray tube having the 110-degree deflection structure as described above, the length of the funnel 2 is greater than that of the panel 1, and the neck part of the funnel 2 is formed in the shape of a smooth curve. Consequently, stress is not concentrated on the funnel 2, and therefore, it is not necessary for the stress to be distributed.

For this reason, the panel 1 is designed such that the ratios of CFT to SET(Tx, Ty, Td) of the panel 1 are the same over all regions as shown in FIG. 4. When the ratios of CFT to SET (Tx, Ty, Td) of the panel 1 were changed, there was no difference in stress, and the reduction of costs was slight. Specifically, the ratios of CFT to SET were slightly different depending upon the size and deflection angle of the tube part 10.

However, the slim cathode ray tube, which has been developed recently, has a deflection structure with a deflection angle of 110 degrees or more. Also, the overall length of the slim cathode ray tube is decreased, and therefore, the inner volume of the slim cathode ray rube is reduced. As a result, stress is further applied to the panel and the funnel. Consequently, it is required that the ratios of CFT to SET of the panel 1 be appropriately set to effectively prevent excessive stress from being applied to the panel and funnel.

Meanwhile, when the tube part 10 is in a vacuum state, considerable tensile and compression stresses are applied to the panel 1 and the funnel 2. Referring to FIGS. 2 and 5, when the tube part 10 is in the vacuum state, the stress of the panel 1 against external impact is transmitted to the funnel 2 via the seal edge 1*x*, 1*y*, and 1*d* at the end of a side wall is of the panel 1. As a result, the stress of the panel 1 is somewhat reduced.

Consequently, the thickness SET and the shape of the side wall is of the panel 1, i.e., the seal edge 1*x*, 1*y*, 1*d* of the panel 1 both have considerable influence on the reliability of the cathode ray tube.

Especially, the explosion-resistance characteristic to external impact and a sparking phenomenon, which is generated when the tube part 10 passes through a furnace such that the panel 1 and the funnel 2 are joined with each other by frit welding at the time of manufacturing the cathode ray tube, are deeply connected with the thickness and the shape of the seal edge of the panel. Furthermore, when the outer skirt angle S of the side wall 1*s* is increased, the productivity in the manufacture of the tube 10 is decreased.

In the conventional panel 1, the outer skirt angle S is approximately 3 to 4 degrees. The outer skirt angle S is the greatest at the long side part 1*x*. The outer skirt angle S is the least at the short side part 1*y*. The outer skirt angle S at the diagonal part 1*d* is less than the outer skirt angle S at the long side part 1*x* and greater than the outer skirt angle S at the short side part 1*y*.

In the panel 1 of the cathode ray tube as described above, the outer skirt angle S of the panel 1 is 3 degrees or more, and the outer skirt angle S is set such that the outer skirt angle S is the greatest at the long side part 1*x*, the outer skirt angle S is the least at the short side part 1*y*, and the outer skirt angle S at the diagonal part 1*d* is less than the outer skirt angle S at the long side part 1*x* and greater than the outer skirt angle S at the short side part 1*y*. As a result, the thickness SET of the long side part 1*x* is less than that of the short side part 1*y*, and therefore, the explosion-resistance characteristic is lowered.

Furthermore, a reinforcing band 11 is wound around the side wall 1*s*, as shown in FIG. 1, to distribute high stress applied to the panel 1. When the outer skirt angle S of the panel 1 is large as described above, however, the reinforcing band 11 can easily slip. Consequently, it is difficult to perform the reinforcing band winding process, and it is difficult to effectively distribute stress applied to the tube part 10 when the reinforcing band 11 slips.

SUMMARY OF THE INVENTION

Therefore, the present invention has been made in view of the above problems, and it is an object of the present invention to provide a panel for slim cathode ray tubes that is capable of uniformly distributing stress concentrated on a funnel due to the reduction of the overall length of the funnel, which is caused by a wide-angle deflection of 110 degrees or more, such that sufficient rigidity is maintained at the slim cathode ray tube.

It is another object of the present invention to provide a panel for slim cathode ray tubes wherein the thickness of a seal edge of the panel is optimized, by appropriately setting the ratios of CFT of the panel to a long side part, a short side part, and a diagonal part of the seal edge of the panel, to prevent the concentration of stress caused by the increase of the deflection angle, whereby damage to the panel is prevented during the production of a tube part, and the implosion rule is satisfied.

It is yet another object of the present invention to provide a panel for slim cathode ray tubes wherein the outer skirt angle of a side wall of the panel is set to 0.5 to 1.5 degrees, whereby the explosion-resistance characteristic and moldability of the panel are improved, and slippage of a reinforcing band is effectively prevented.

In accordance with one aspect of the present invention, the above and other objects can be accomplished by the provision of a panel of a slim cathode ray tube constructed such that the deflection angle of an electron beam is 110 degrees or more, the slim cathode ray tube including a tube part constituted by joining the panel and a funnel with each other, wherein the panel includes a face part, on which a picture appears, a side wall disposed around the face part such that the side wall is bent toward the funnel, and a seal edge formed at the side wall, the panel being joined with the funnel at the seal edge, on the assumption that the thickness of the center of the face part is Tc, the thickness of the long side of the seal edge is Tx, the thickness of the short side of the seal edge is Ty, and the thickness of the diagonal part of the seal edge is Td, the panel is constructed such that the following inequalities are satisfied: $0.8 \leqq Tc/Ty \leqq Tc/Tx \leqq 1.0 \leqq Tc/Td$ and $Td<Tx<Ty$, and the side wall has an outer skirt angle of 0.5 to 1.5 degrees.

Preferably, the panel is constructed such that the following inequalities are satisfied: $0.75<Td/Tx<1.0$ and $0.74<Td/Ty<1.0$.

Preferably, the tube part has an overall length of 350 mm or less, and panel has a diagonal size of approximately 700 to 800 mm.

Preferably, the panel is formed approximately in a rectangular structure, and the outer skirt angle is set such that the following inequality is satisfied: the outer skirt angle at the short side>the outer skirt angle at the diagonal part>the outer skirt angle at the long side.

In accordance with another aspect of the present invention, there is provided a panel of a slim cathode ray tube constructed such that the deflection angle of an electron beam is 110 degrees or more, the slim cathode ray tube including a tube part constituted by joining the panel and a funnel with each other, wherein the panel includes a face part, on which a picture appears, and a seal edge disposed around the face part such that the seal edge is bent toward the funnel, the panel being joined with the funnel at the seal edge, and, on the assumption that the thickness of the center of the face part is Tc, the thickness of the long side of the seal edge is Tx, the thickness of the short side of the seal edge is Ty, and the thickness of the diagonal part of the seal edge is Td, the panel is constructed such that the following inequality is satisfied: $0.8 \leqq Tc/Ty \leqq Tc/Tx \leqq 1.0 \leqq Tc/Td$.

Preferably, the panel is constructed such that one of the following inequalities is satisfied: $Td<Tx<Ty$, $Td<Tx \leqq Ty$, and $Td \leqq Tx<Ty$.

In accordance with another aspect of the present invention, there is provided a panel of a slim cathode ray tube constructed such that the deflection angle of an electron beam is 110 degrees or more, the slim cathode ray tube including a tube part constituted by joining the panel and a funnel with each other, wherein the panel includes a seal edge disposed therearound such that the seal edge is bent toward the funnel, the panel being joined with the funnel at the seal edge, and, on the assumption that the thickness of the long side of the seal edge is Tx, the thickness of the short side of the seal edge is Ty, and the thickness of the diagonal part of the seal edge is Td, the panel is constructed such that the following inequality is satisfied: $Td<Tx<Ty$.

Preferably, the panel is constructed such that the following inequalities are satisfied: $0.75<Td/Tx<1.0$ and $0.74<Td/Ty<1.0$.

In accordance with yet another aspect of the present invention, there is provided a panel of a slim cathode ray tube constructed such that the deflection angle of an electron beam is 110 degrees or more, the slim cathode ray tube including a tube part constituted by joining the panel and a funnel with each other, wherein the panel includes a side wall disposed therearound such that the side wall is bent toward the funnel, and the side wall has an outer skirt angle of 0.5 to 1.5 degrees.

Preferably, the panel is formed approximately in a rectangular structure, and the outer skirt angle is set such that the following inequality is satisfied: the outer skirt angle at the short side>the outer skirt angle at the diagonal part>the outer skirt angle at the long side.

According to the present invention, the thickness of the center of the panel, and the thicknesses of the long side, the short side, and the diagonal part of the seal edge are appropriately set so as to uniformly distribute the stress locally concentrated on the tube part due to the increase of the deflection angle. Consequently, the present invention has the effect of improving the explosion-resistance characteristic and providing sufficient rigidity even through the overall length of the tube part is reduced.

Also, the thickness of the seal edge of the panel is appropriately set according to the present invention. Consequently, damage to the panel is prevented during the production of the tube part, and the implosion rule is satisfied.

Furthermore, the outer skirt angle of the panel is set to 0.5 to 1.5 degrees, and the outer skirt angle of the panel is set such that the following inequality is satisfied: the outer skirt angle at the short side>the outer skirt angle at the diagonal part>the outer skirt angle at the long side. As a result, the vacuum stress is uniformly distributed. Consequently, the explosion-resistance characteristic and moldability of the panel are improved, and slippage of the reinforcing band is effectively prevented.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
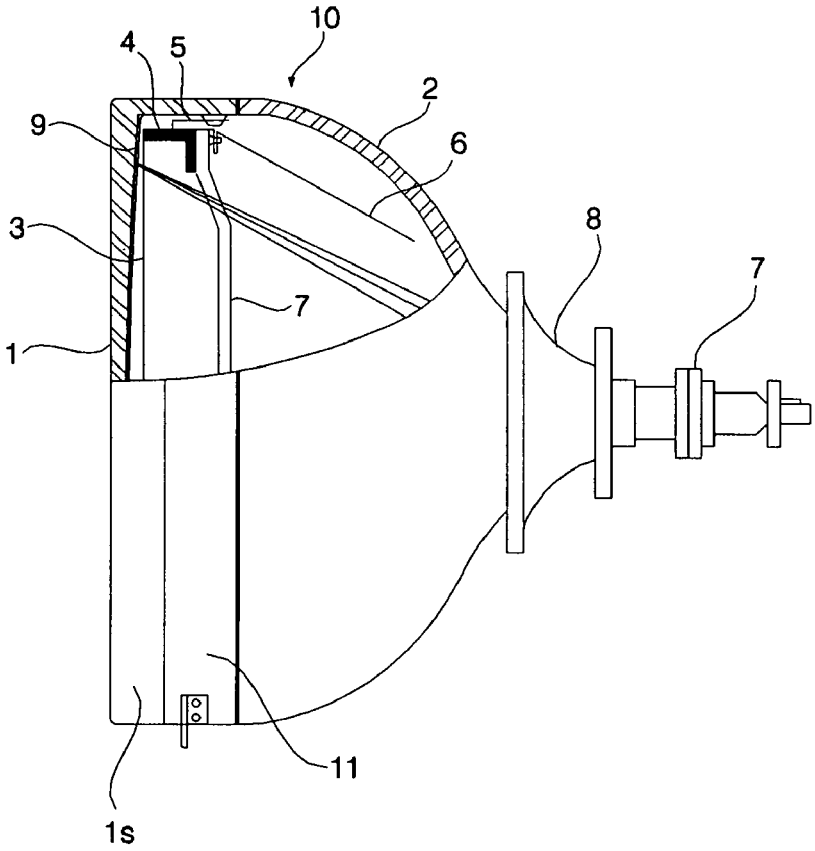
FIG. 1 (Prior Art)
FIG. 1 is a side view, partially cut away, illustrating a conventional cathode ray tube.
Figure 2:
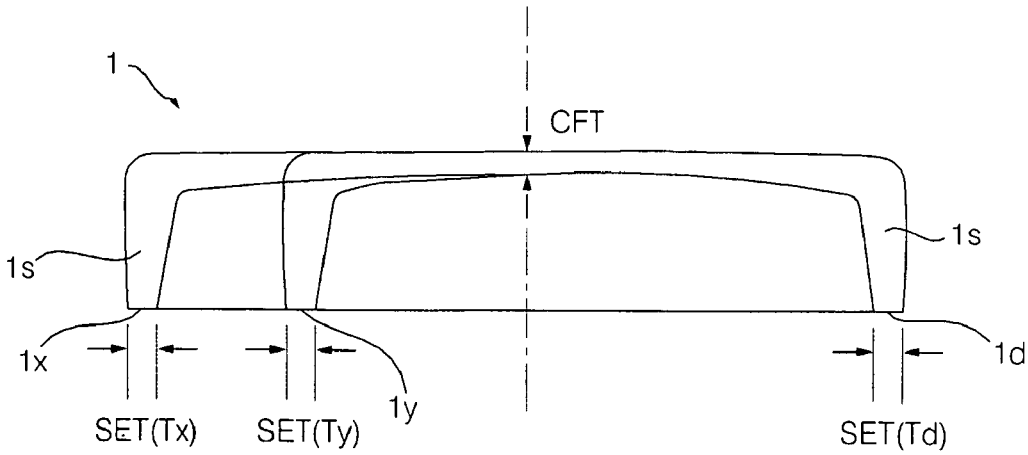
FIG. 2 (Prior Art)
FIG. 2 is a sectional view illustrating a panel constituting the conventional cathode ray tube.
Figure 3:
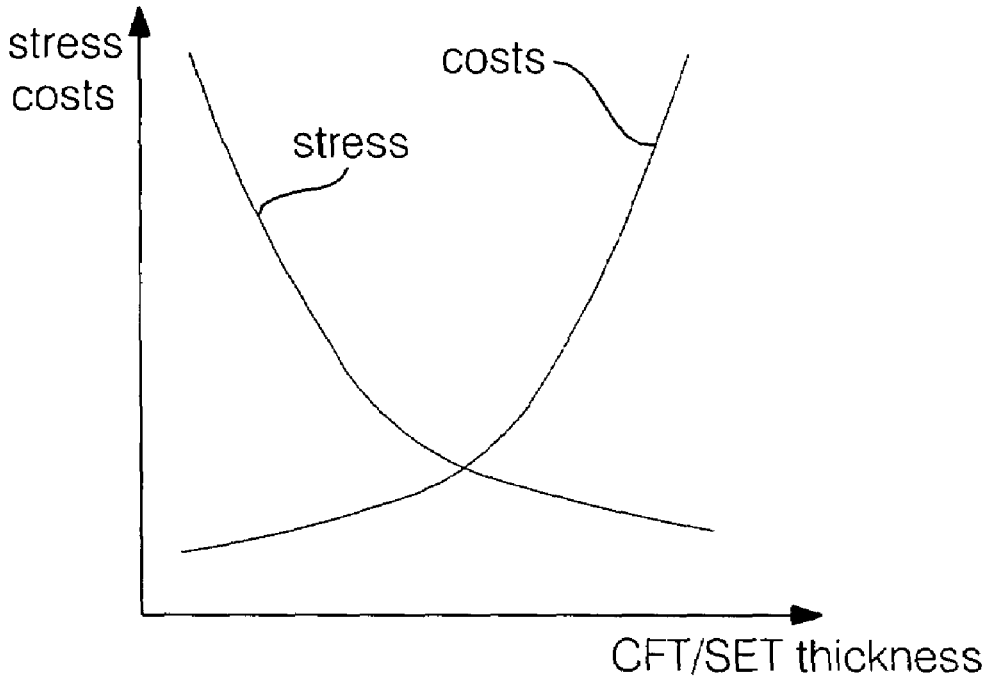
FIG. 3 is a graph illustrating the change in stress and costs depending upon the CFT/SET ratio of a general panel.
Figure 4:
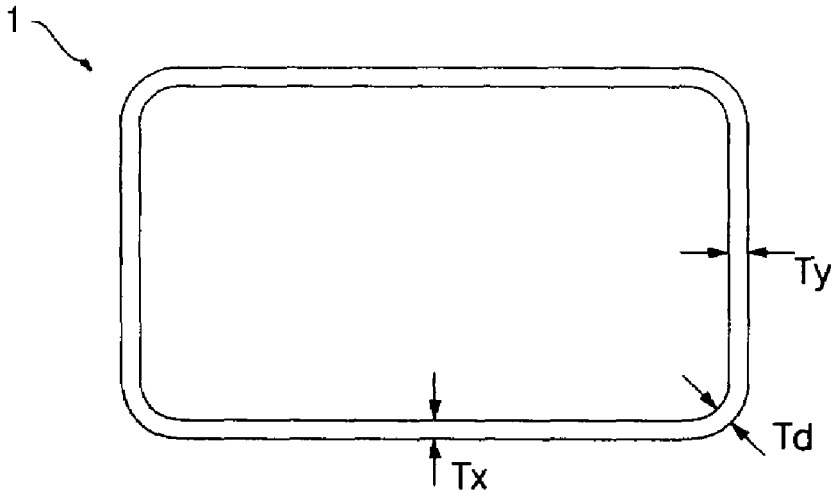
FIG. 4 is a rear view illustrating the thickness of a seal edge of the panel of the conventional cathode ray tube.
Figure 5:
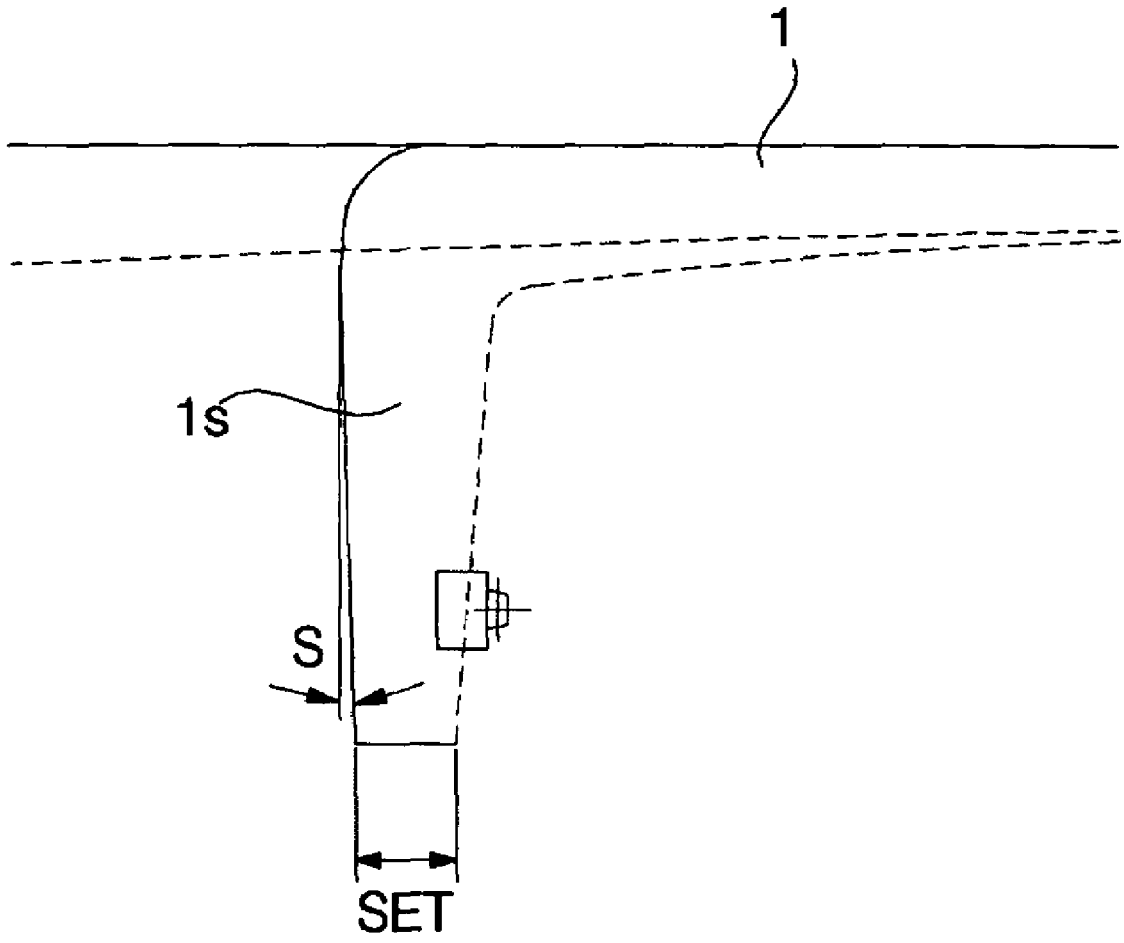
FIG. 5 is a detailed view illustrating the outer skirt angle of the panel of the conventional cathode ray tube.
Figure 6:
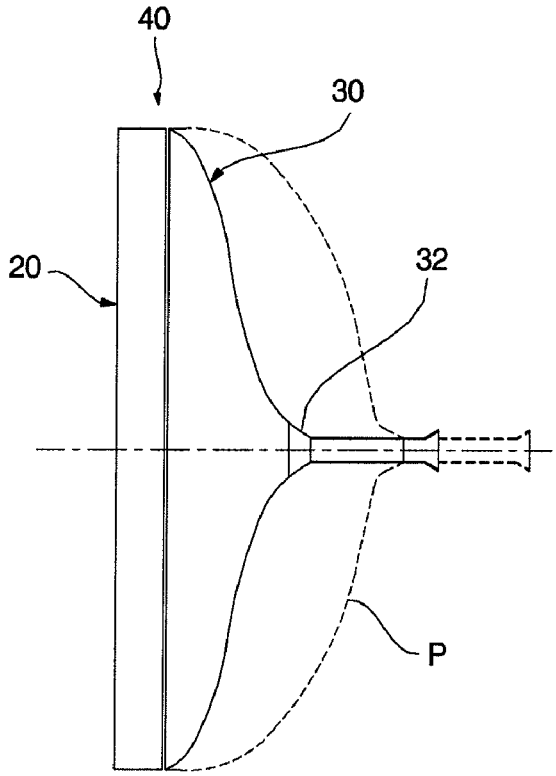
FIG. 6 is a side view schematically illustrating a cathode ray tube to which a panel according to the present invention is applied.

FIG. 6 is a side view schematically illustrating a cathode ray tube to which a panel according to the present invention is applied.

Preferably, the panel according to the present invention is applied to a slim cathode ray tube having a deflection angle of 110 degrees of more.

The slim cathode ray tube shown in FIG. 6 has a deflection angle of 110 degrees or more. Also, the slim cathode ray tube includes a tube part 40, the overall length of which is 350 mm or less. The overall length of the tube part 40, which is formed by joining a panel 20 and a funnel 30 with each other, is less than that of a tube part P of a conventional cathode ray tube, which is shown in FIG. 6 by a dotted line.

The size of the funnel 30 of the slim cathode ray tube is remarkably reduced as compared to the size of the funnel of the conventional cathode ray tube while the size of the panel 20 is not reduced. Consequently, stress widely distributed at the funnel is concentrated on a neck part 32 of the funnel 30, and therefore, the explosion-resistance characteristic and rigidity of the slim cathode ray tube may be lowered.

For this reason, the shape of the panel 20 is changed, according to the present invention, to distribute stress concentrated on the neck part 32 of the funnel due to the decrease of the overall length of the tube part 40 over the panel 20, so that the distribution of stress applied to the tube part 40 is uniform, and therefore, the tube part 40 has sufficient rigidity.

Furthermore, the outer skirt angle of a side wall of the panel 20 is changed, according to the present invention, to improve the explosion-resistance characteristic and prevent slippage of a reinforcing band wound around the side wall of the panel 20.

Figure 7:
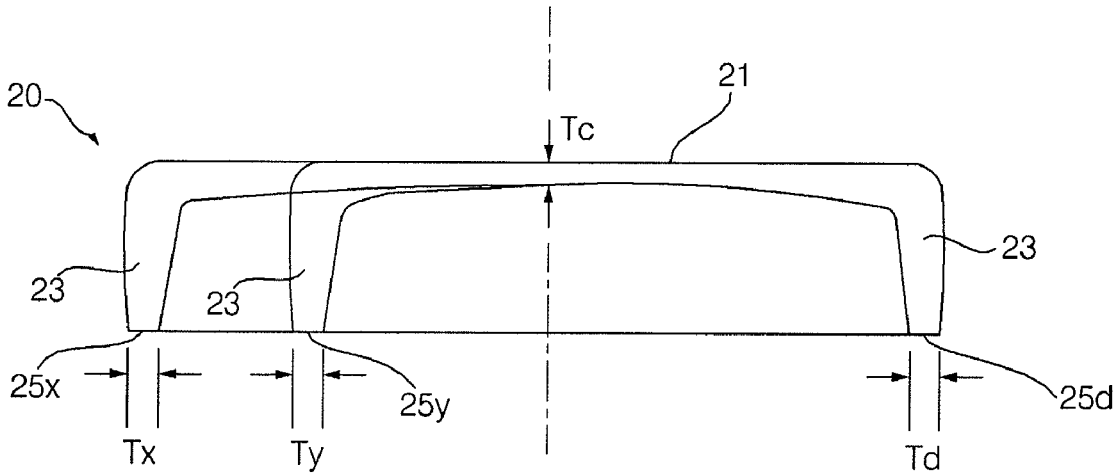
FIG. 7 is a view illustrating the thickness ratios of the panel of the slim cathode ray tube according to the present invention.
Figure 8:
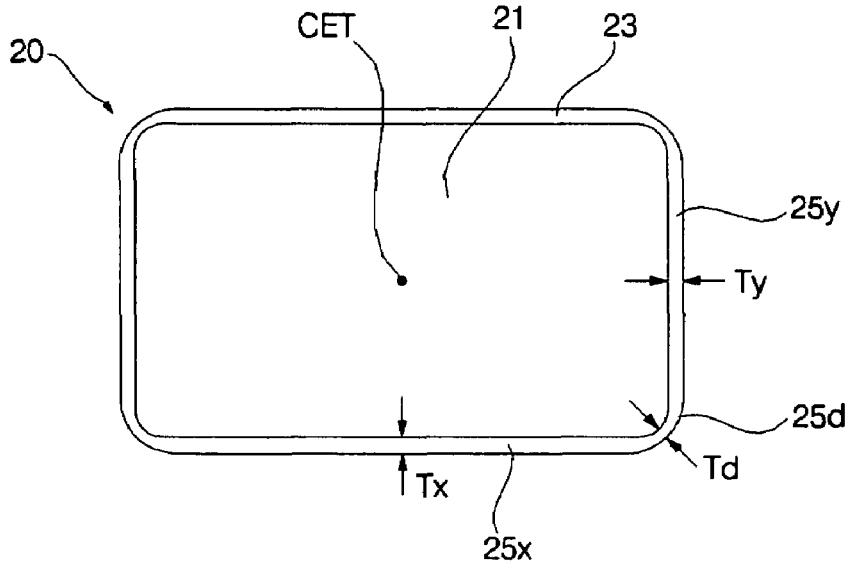
FIG. 8 is a rear view illustrating the thickness of a seal edge of the panel of the slim cathode ray tube according to the present invention.

FIG. 7 is a view illustrating the thickness ratios of the panel of the slim cathode ray tube according to the present invention, and FIG. 8 is a rear view illustrating the thickness of a seal edge of the panel of the slim cathode ray tube according to the present invention.

The panel 20 includes a face part 21, on which a picture appears. Around the face part 21 is disposed a side wall 23, which is bent toward the funnel 30. At the side wall 23 is formed a seal edge 25*s*, 25*y*, and 25*d*, at which the panel is joined with the funnel 30.

The panel 20 has a diagonal size of approximately 700 to 800 mm, and therefore, the panel can be appropriately applied to the slim cathode ray tube.

The face part 21 is formed approximately in a rectangular structure. The thickness of the face part 21 is the least at the center thereof.

Since the face part 21 is formed approximately in the rectangular structure, the side wall 23 and the seal edge 25*x*, 25*y*, and 25*d* are constituted by horizontal long sides 25*x*, vertical short sides 25*y*, and diagonal parts 25*d*, which form the corners of the panel 20.

Here, on the assumption that the thickness of the center of the face part 21 (CFT) is Tc, the thickness of the long side 25*x* of the seal edge is Tx, the thickness of the short side 25*y* of the seal edge is Ty, and the thickness of the diagonal part 25*d* of the seal edge is Td, the panel 20 is constructed, such that the following inequality is satisfied: $0.8 \leqq Tc/Ty \leqq Tc/Tx \leqq 1.0 \leqq Tc/Td$, to uniformly distribute stress.

When CFT is decreased, stress is concentrated on the face part 21, and therefore, the rigidity of the face part 21 is reduced. As a result, poor results may be obtained from an explosion-resistance test, a missile test, and an X-ray test.

The side wall 23 is a portion to which the funnel 30 is connected. When the thickness of the side wall 23 is too small, the connection force between the side wall 23 and the funnel 30 is decreased. As a result, stress is concentrated on the connection between the panel 20 and the funnel 30, and therefore, the rigidity of the slim cathode ray tube is lowered.

Consequently, the panel 20 is constructed such that the thickness of the long side 25*x* and the thickness of the short side 25*y* are equal to or greater than CFT, and the thickness of the diagonal part 25*d* is less than CFT.

When the thickness Tx of the long side 25*x* and the thickness Ty of the short side 25*y* are excessively increased, however, stress is concentrated on the face part 21. Consequently, in order to uniformly distribute the stress concentrated on the face part 21, it is preferable to construct the panel 20 such that $Tc/Ty \geqq 0.8$ or $Tc/Ty \geqq 0.8$. Also, it is possible to construct the panel 20 such that the long side 25*x* and the short side 25*y* have the same thickness. In this case, however, stress is concentrated more on the long side 25*x* than on the short side 25*y*.

Consequently, in order to uniformly distribute the stress concentrated on the face part 21, it is preferable to construct the panel 20 such that the thickness Tx of the long side 25*x* is less than the thickness Ty of the short side 25*y*.

The diagonal part 25*d* has higher rigidity against the stress than the long side 25*x* and the short side 25*y*. Consequently, in order to uniformly distribute the stress, it is preferable to construct the panel 20 such that the thickness Td of the diagonal part 25*d* is less than CFT as well as the thickness Tx of the long side 25*x* and the thickness Ty of the short side 25*y*.

In conclusion, the panel 20 is constructed such that the thickness of the short side 25*y* is the greatest, the thickness of the long side 25*x* is less than the thickness of the short side 25*y* and greater than the thickness of the center of the face part 21, the thickness of the center of the face part 21 is less than the thickness of the long side 25*x* and greater than the thickness of the diagonal part 25*d*, and the thickness of the diagonal part 25*d* is the least. As a result, stress is uniformly distributed on the panel 20 and the funnel 30, and therefore, the balance of stress between the panel 20 and the funnel 30 is appropriately maintained.

Alternatively, the panel 20 may be constructed such that the thickness Ty of the short side 25*y* and the thickness Tx of the long side 25*x* are the same, the thickness Tx of the long side 25*x* is equal to CFT, or CFT and the thickness Td of the diagonal part 25*d* are the same.

In the slim cathode ray tube according to the present invention, the thicknesses of the short side 25*y*, the long side 25*x*, the center of the face part 21, and the diagonal part 25 are appropriately set in the order of the short side 25*y*, the long side 25*x*, the center of the face part 21, and the diagonal part 25, as described above, and therefore, stress concentrated on the neck part 32 of the funnel 30 is appropriately distributed to the panel 20.

In the above description, the thicknesses SET(Tx, Ty, Td) of the seal edge 25*x*, 25*y*, 25*d* are set in consideration of CFT. However, it is also possible to set thicknesses SET(Tx, Ty, Td) of the seal edge 25*x*, 25*y*, 25*d* irrespective of CFT, which will be described in more detail below.

In order to uniformly distribute the stress, it is preferable to construct the panel 20 such that the following inequality is satisfied: Td≠Tx≠Ty. That is to say, it is preferable to construct the panel 20, such that the thicknesses of the diagonal part, the long side, and the short side of the seal edge are different, so as to uniformly distribute the stress.

More preferably, the panel 20 is constructed such that the following inequality is satisfied: Td<Tx<Ty.

The side wall 23 of the panel 20 is a portion to which the funnel 30 is connected. When the thickness of the side wall 23 is excessively decreased, the connection force between the side wall 23 and the funnel 30 is decreased. As a result, stress is concentrated on the connection between the panel 20 and the funnel 30, and therefore, the rigidity of the slim cathode ray tube is lowered.

Also, stress is concentrated more on the long side 25*x* of the panel 20 than on the short side 25*y* of the panel 20. Consequently, in order to uniformly distribute the stress concentrated on the face part 21 and the funnel 30, it is preferable to construct the panel 20 such that the thickness Tx of the long side 25*x* is less than the thickness Ty of the short side 25*y*.

Also, the diagonal part 25*d* has higher rigidity against the stress than the long side 25*x* and the short side 25*y*. Consequently, in order to uniformly distribute the stress, it is preferable to construct the panel 20 such that the thickness Td of the diagonal part 25*d* is less than the thickness Tx of the long side 25*x* and the thickness Ty of the short side 25*y*.

In conclusion, the panel 20 is constructed such that the thickness of the short side 25*y* is the greatest, the thickness of the long side 25*x* is less than the thickness of the short side 25*y* and greater than the thickness of the diagonal part 25*d*, and the thickness of the diagonal part 25*d* is the least. As a result, stress generated on the panel 20 and the funnel 30 is uniformly distributed through the seal edge, and therefore, the balance of stress between the panel 20 and the funnel 30 is appropriately maintained.

TABLE 1

| | | | Experiment 1 of the invention | Experiment 2 of the invention | Conventional experiments | |
|---|---|---|---|---|---|---|
| SET | Tx | | 15.8 | 15.8 | 11 | 11.4 |
| | Ty | | 16 | 16 | 11 | 11.4 |
| | Td | | 12.5 | 11.85 | 11 | 11.4 |
| | Td/Tx | | 0.791 | 0.750 | 1.000 | 1.000 |
| | Td/Ty | | 0.781 | 0.741 | 1.000 | 1.000 |
| Stress (Mpa) | Side wall | | 8.4 | 8.2 | 9.7 | 9.65 |
| | Seal edge | x-axis | 9.2 | 9.5 | 13.5 | 12.8 |
| | | y-axis | 9.5 | 10.1 | 13.9 | 13.4 |
| | | d-axis | 8.2 | 10.8 | 9.2 | 8.8 |
| | Funnel body | | 9.8 | 9.9 | 12.9 | 12.5 |
| | Yoke part | | 8.4 | 8.1 | 12.5 | 12.7 |

It can be seen from the results of conventional experiments that, when the thicknesses SET(Tx, Ty, Td) of the seal edge were the same, for example, 11 mm or 11.4 mm, the stresses distributed on the long side, the short side, and the diagonal part of the seal edge were approximately 8.8 to 13.9 Mpa, which is very high.

Specifically, when the thicknesses SET(Tx, Ty, Td) of the seal edge were the same, considerable stress is concentrated on the long side 25*x* and the short side 25, and considerable stress is also concentrated on the funnel body and the yoke part of the funnel 30. As a result, stress is concentrated on the tube part 40, and therefore, the tube part 40 is easily damaged or imploded.

It can be seen from the results of Experiment 1 of the present invention, however, that, when the thickness of the short side 25*y* was set to 16 mm, the thickness of the long side 25*x* was set to 15.8 mm, and the thickness of the diagonal part 25*d* was set to 12.5 mm, the stress distributed on the long side, the short side, and the diagonal part of the seal edge were approximately 8.2 to 9.8 Mpa, which is very low. In this case, Td/Tx was 0.791, and Td/Ty was 0.781.

Consequently, when the thicknesses SET(Tx, Ty, Td) of the seal edge are appropriately set in the order of the short side 25*y*, the long side 25*x*, and the diagonal part 25*d*, as in Experiment 1 of the present invention, the stress does not exceed the stress limit of the tube part 40, i.e., 10 Mpa.

It can be seen from the results of Experiment 2 of the present invention, on the other hand, that, when the thickness of the short side 25*y* was set to 16 mm, the thickness of the long side 25*x* was set to 15.8 mm, and the thickness of the diagonal part 25*d* was set to 11.85 mm, the stress distributed on the long side, the short side, and the diagonal part were approximately 8.1 to 10.8 Mpa, the deviation of which was increased as compared to Experiment 1 of the present invention. In this case, Td/Tx was 0.750, and Td/Ty was 0.741.

Consequently, it can be seen that, although the stresses applied to the respective components of the tube parts 40 under the conditions of Experiment 2 of the present invention was lower than those applied to the respective components of the tube parts 40 under the conditions of conventional experiments, the stresses of the short side and the diagonal part exceed 10 Mpa, and therefore, the stress limit was not satisfied. For this reason, it is preferable to construct the panel 20 such that the following inequalities are satisfied: $0.75<Td/Tx<1.0$ and $0.74<Td/Ty<1.0$.

As described above, the thicknesses of the short side 25*y*, the long side 25*x*, and the diagonal part 25*d* are appropriately set such that the thickness of the short side 25*y* is the greatest, the thickness of the long side 25*x* is less than the thickness of the short side 25*y* and greater than the thickness of the diagonal part 25*d*, and the thickness of the diagonal part 25*d* is the least and such that the following inequalities are satisfied: $0.75<Td/Tx<1.0$ and $0.74<Td/Ty<1.0$. Consequently, the stress locally concentrated at the slim cathode ray tube is uniformly distributed through the seal edge.

In the above description, the panel 20 is constructed such that the following inequality is satisfied: $Td<Tx<Ty$. Alternatively, the panel 20 may be constructed such that the following inequality is satisfied: $Td<Tx\leqq Ty$ or $Td\leqq Tx<Ty$.

Figure 9:
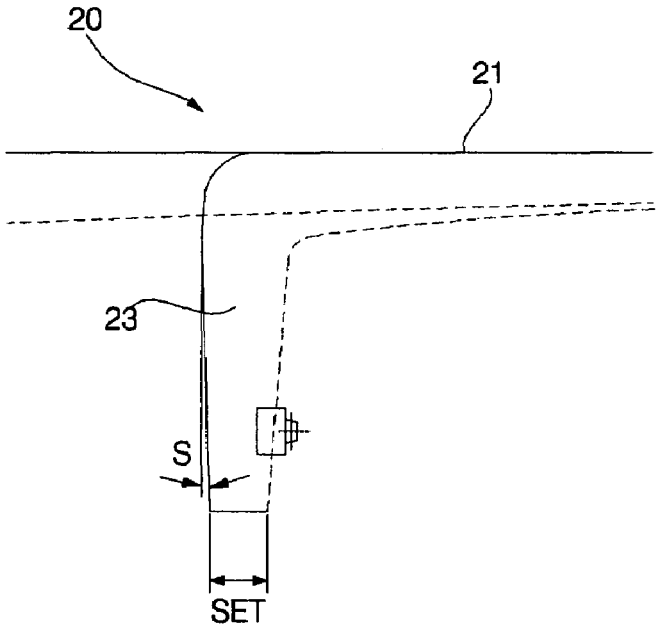
FIG. 9 is a detailed view illustrating the outer skirt angle of the panel of the slim cathode ray tube according to the present invention.

FIG. 9 is a detailed view illustrating the outer skirt angle S of the panel of the slim cathode ray tube according to the present invention.

Referring to FIG. 9, the outer skirt angle S of the side wall 23 is 0.5 to 1.5 degrees. Preferably, the outer skirt angle S of the side wall 23 is approximately 1.34 degrees.

Also preferably, the outer skirt angle S of the side wall 23 is set such that the following inequality is satisfied: the outer skirt angle at the short side 25*y*>the outer skirt angle at the diagonal part 25*d*>the outer skirt angle at the long side 25*x*.

On the assumption that the thickness of the long side 25*x* of the seal edge is Tx, the thickness of the short side 25*y* of the seal edge is Ty, and the thickness of the diagonal part 25*d* of the seal edge is Td, the thickness SET of the side wall 23 is set depending on the outer skirt angle S such that the thickness of the long side 25*x* is the greatest, the thickness of the short side 25*y* is the least, the thickness of the diagonal part 25*d* is less than that of the long side 25*x* and greater than that of the short side 25*y*.

In the slim cathode ray tube having a deflection angle of 110 degrees or more, the overall length of the tube part 40, which is constituted by joining the panel 20 and the funnel 30 with each other, is reduced, and therefore, vacuum stress applied to the panel 20 and the funnel 30 is increased.

According to the present invention, however, the outer skirt angle S of the side wall 23 of the panel 20 is set to approximately 0.5 to 1.5 degrees, which is less than a conventional outer skirt angle of 3 to 4 degrees. As a result, the thickness SET of the seal edge of the side wall 23 is increased as compared to the conventional art. Consequently, the panel 20 according to the present invention can sufficiently endure the vacuum stress, which is increased as the overall length of the tube part 40 is decreased.

Also, since the outer skirt angle S of the panel 20 is small as described above, the damage to the panel, which may be caused when the panel 20 is removed from a mold during the production of the panel 20, is effectively prevented, and therefore, the productivity in the manufacture of the panel 20 is improved.

Furthermore, the outer skirt angle S of the panel 20 is set such that the following inequality is satisfied: the outer skirt angle at the short side 25*y*>the outer skirt angle at the diagonal part 25*d*>the outer skirt angle at the long side 25*x*. As a result, the panel 20 is constructed such that the thickness Tx of the long side 25*x*, which is the major portion of the panel 20, is the greatest, the thickness Ty of the short side 25*y* is the least, the thickness Td of the diagonal part 25*d* is less than the thickness Tx of the long side 25*x* and greater than the thickness Ty of the short side 25*y*. Consequently, the vacuum stress is effectively distributed, and therefore, the explosion-resistance characteristic is improved.

In addition, since the outer skirt angle S of the panel 20 is decreased, slippage of a reinforcing band is prevented when the reinforcing band is wound around the side wall 23.

As apparent from the above description, the thickness of the center of the panel, and the thicknesses of the long side, the short side, and the diagonal part of the seal edge are appropriately set so as to uniformly distribute the stress locally concentrated on the tube part due to the increase of the deflection angle. Consequently, the present invention has the effect of improving the explosion-resistance characteristic and providing sufficient rigidity even through the overall length of the tube part is reduced.

Also, the thickness of the seal edge of the panel is appropriately set according to the present invention. Consequently, damage to the panel is prevented during the production of the tube part, and the implosion rule is satisfied.

Furthermore, the outer skirt angle of the panel is set to 0.5 to 1.5 degrees, and the outer skirt angle of the panel is set such that the following inequality is satisfied: the outer skirt angle at the short side>the outer skirt angle at the diagonal part>the outer skirt angle at the long side. As a result, the vacuum stress is uniformly distributed. Consequently, the explosion-resistance characteristic and moldability of the panel are improved, and slippage of the reinforcing band is effectively prevented.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A panel of a slim cathode ray tube constructed such that the deflection angle of an electron beam is 110 degrees or more, the slim cathode ray tube including a tube part constituted by joining the panel and a funnel with each other, wherein the panel includes a face part, on which a picture appears, a side wall disposed around the face part such that the side wall is bent toward the funnel, and a seal edge formed at the side wall, the panel being joined with the funnel at the seal edge, wherein the thickness of the center of the face part is Tc, the thickness of the long side of the seal edge is Tx, the thickness of the short side of the seal edge is Ty, and the thickness of the diagonal part of the seal edge is Td, the panel is constructed such that the following inequalities are satisfied: $0.8\leqq Tc/Ty\leqq Tc/Tx\leqq 1.0\leqq Tc/Td$ and $Td<Tx<Ty$, and the side wall has an outer skirt angle of 0.5 to 1.5 degrees, wherein the panel is formed substantially in a rectangular structure, and the outer skirt angle is set such that the following inequality is satisfied: the outer skirt angle at the short side>the outer skirt angle at the diagonal part>the outer skirt angle at the long side.

2. The panel as set forth in claim 1, wherein the panel is constructed such that the following inequalities are satisfied: $0.75<Td/Tx<1.0$ and $0.74<Td/Ty<1.0$.

3. The panel as set forth in claim 1, wherein the tube part has an overall length of 350 mm or less.

4. The panel as set forth in claim 1, wherein the panel has a diagonal size of approximately 700 to 800 mm.

5. A panel of a slim cathode ray tube constructed such that the deflection angle of an electron beam is 110 degrees or more, the slim cathode ray tube including a tube part constituted by joining the panel and a funnel with each other, wherein the panel includes a side wall disposed therearound such that the side wall is bent toward the funnel, and the side wall has an outer skirt angle of 0.5 to 1.5 degrees, wherein the panel is formed substantially in a rectangular structure, and the outer skirt angle is set such that the following inequality is satisfied: the outer skirt angle at the short side>the outer skirt angle at the diagonal part>the outer skirt angle at the long side.

6. The panel as set forth in claim 5, wherein the panel has a diagonal size of approximately 700 to 800 mm.

7. The panel as set forth in claim 5, wherein the panel further includes a face part, on which a picture appears, and a seal edge disposed around the face part such that the seal edge is bent toward the funnel, the panel being joined with the funnel at the seal edge, and wherein that the thickness of the center of the face part is Tc, the thickness of the long side of the seal edge is Tx, the thickness of the short side of the seal edge is Ty, and the thickness of the diagonal part of the seal edge is Td, the panel is constructed such that the following inequality is satisfied: $0.8 \leqq Tc/Ty \leqq Tc/Tx \leqq 1.0 \leqq Tc/Td$.

8. The panel as set forth in claim 5, wherein the panel further includes a seal edge disposed therearound such that the seal edge is bent toward the funnel, the panel being joined with the funnel at the seal edge, and wherein the thickness of the long side of the seal edge is Tx, the thickness of the short side of the seal edge is Ty, and the thickness of the diagonal part of the seal edge is Td, the panel is constructed such that the following inequality is satisfied: $Td<Tx<Ty$.

9. The panel as set forth in claim 8, wherein the panel is constructed such that the following inequalities are satisfied: $0.75<Td/Tx<1.0$ and $0.74<Td/Ty<1.0$.

* * * * *